US006036557A

United States Patent [19]

Morikami

[11] Patent Number: 6,036,557

[45] Date of Patent: Mar. 14, 2000

[54] STRUCTURE FOR MOUNTING ELECTRONIC COMPONENTS ON AN OUTBOARD MOTOR

[75] Inventor: Tadaaki Morikami, Shizuoka-ken, Japan

[73] Assignee: Suzuki Motor Corporation, Japan

[21] Appl. No.: 09/018,816

[22] Filed: Feb. 4, 1998

[30] Foreign Application Priority Data

Feb. 5, 1997 [JP] Japan ..... 9-022992

[51] Int. Cl.[7] ..... B63H 1/14

[52] U.S. Cl. ..... 440/53; 440/88; 123/195 P

[58] Field of Search ..... 123/195 P, 195 E; 440/88, 89, 900

[56] References Cited

U.S. PATENT DOCUMENTS 5,694,895 12/1997 Tsunoda et al. ..... 123/195 P

FOREIGN PATENT DOCUMENTS 3-32998 2/1991 Japan .

*Primary Examiner*—Ed Swinehart

*Attorney, Agent, or Firm*—Morrison Law Firm

[57] ABSTRACT

A heat-discharging electronic component is mounted in an unused space on the side of an engine of an outboard motor without unnecessarily restricting the layout of parts in the outboard motor, or increasing the number of parts or assembly steps. The unused space is a cavity between a side of the engine, an exhaust manifold, and an electronics box spaced apart from the exhaust manifold to form the cavity. The cavity is further defined by a perpendicular projection of a cover member covering the upper portion of the engine. Fixing bolts remain accessible below the cover member when a removable cover is removed, thereby improving accessibility of the heat-generating electronic component. Locating the cavity under the perpendicular projection of the fixed cover member improves protection against the entry of moisture into the heat-generating electronic component.

7 Claims, 4 Drawing Sheets

STRUCTURE FOR MOUNTING ELECTRONIC COMPONENTS ON AN OUTBOARD MOTOR

BACKGROUND OF THE INVENTION

The present invention relates to a structure for mounting electronic components on an outboard motor.

In many outboard motors having four-cycle engines, intake devices such as carburetors are disposed on one side of the engine, and exhaust manifolds (exhaust collecting tubes) are disposed on the other side of the engine. An electronic components box containing electronic components that do not radiate heat, such as fuses and relays, is disposed on the same side of the engine as the exhaust manifold. An example of this type of arrangement is found in the outboard motor disclosed in Japanese laid-open patent publication number 3-32998.

The intake device takes up a large amount of space on one side of the engine. The electronic components box is disposed opposite from the intake device to prevent the intake device and the electronic component holder from interfering with each other. Also, a large amount of space is available on the side surface of the engine away from the intake device. Thus, placing the electronic components box there provides a balanced layout of parts overall.

Electronic components that radiate heat, such as regulators, must be mounted in a location outside the electronic components box where they are inaccessible to the user. For this reason, electronic components that radiate heat, such as regulators, have been conventionally mounted below a starter motor disposed below the front surface of the engine.

However, in outboard motors equipped with fuel injection intake devices, the intake device, which is large, extends around from a side surface of the engine toward the front surface. Thus, in such cases, heat-discharging electronic components cannot be mounted below the starter motor at the front of the engine. Even if it were possible to mount the parts there, the parts would have to be positioned below the engine, making them difficult to remove and exposing them to moisture.

Conventionally, a dedicated space on a side surface of the engine or the like was specially partitioned solely to mount electronic components that radiate heat. Since the user should not be able to touch the heat-discharging electronic components, protective measures are also required. This makes laying out the parts for the outboard motor difficult, and increases the number of required parts and steps involved in assembly.

OBJECTS AND SUMMARY OF THE INVENTION

The structure for mounting parts of an outboard motor according to the present invention was developed to overcome the problems described above. A first object of the present invention is to use the dead space around the engine efficiently to allow heat-discharging electronic components to be mounted without unnecessarily restricting the layout of parts in the outboard motor, without requiring an increase in the number of parts or assembly steps, while improving the degree to which the heat-discharging electronic components are protected from water.

A second object of the invention it to provide a structure for mounting parts of an outboard motor which allows the heat-discharging electronic component to be easily inserted and removed.

A third object of the structure for mounting parts of an outboard motor according to the present invention is to provide improved cooling for the heat-discharging electronic components.

A third object of the structure for mounting parts of an outboard motor according to the present invention is to make it difficult for the user to come into contact with the heat-discharging electronic components. This object is preferably satisfied without requiring a more complex structure.

A fourth object of the structure for mounting electronic components of an outboard motor according to the present invention is to prevent the user from coming into contact with the heat-discharging electronic component without requiring a more complex structure.

In order to achieve the first object, the present invention according to the invention includes a structure for mounting electronic components of an outboard motor wherein: an intake device is disposed on one side surface of the engine, and an exhaust manifold and an electronic components box are disposed on the other side surface of the engine. A heat-discharging electronic component is mounted separately in a cavity formed between the side surface of the engine and the exhaust manifold and the electronics parts box.

In order to achieve the second object, the present invention according to the invention a structure for mounting electronic components of an outboard motor wherein: the heat-discharging electronic component is disposed above a dividing line (when viewed from the side) of an engine cover covering the entire engine and dividable into upper and lower sections, and a fixing section is disposed at a position where it is not covered by other members.

In order to achieve the third object, the present invention according to the invention includes a structure for mounting electronic components of an outboard motor wherein: heat-discharging fins disposed on the heat-discharging electronic component are longitudinally oriented vertically.

In order to achieve the fourth object, the present invention according to the invention includes a structure for mounting electronic components of an outboard motor wherein: cooling pipes connected to the engine and the exhaust manifold are disposed to extend to the outside and to the side of the heat-discharging electronic component.

With the configuration described above, the heat-discharging electronic component can be mounted in otherwise dead space at the side surface of the engine efficiently. Thus, the overall layout of parts in the outboard motor remains simple. Since the heat-discharging electronic component is mounted in a cavity, the user is prevented from coming into contact with the heat-discharging electronic component without the need for a special protective measure, thus eliminating the need to increase the number of required parts and assembly steps. The cover member covering the upper portion of the engine blocks water dropping down from above, thus protecting the heat-discharging part from moisture.

With the configuration described above, the heat-discharging electronic component is removable simply by removing the upper engine cover. This allows the heat-discharging electronic component to be easily inserted and removed.

With the configuration described above, a rotating member mounted in the cover member covering the upper portion of the engine is rotated to generate a cooling flow. This cooling flow flows between the heat-discharging fins of the heat-discharging electronic component, thus improving the cooling of the heat-discharging electronic component.

With the configuration described above, a cooling water pipe serves as a protective member for the heat-discharging electronic component. This prevents the user from coming into contact with the heat-discharging electronic component without requiring special protective measures involving a more complex structure.

Briefly stated, the present invention provides a technique for mounting a heat-discharging electronic component in an unused space on the side of an engine of an outboard motor without unnecessarily restricting the layout of parts in the outboard motor, or increasing the number of parts or assembly steps. The unused space is a cavity between a side of the engine, an exhaust manifold, and an electronics box spaced apart from the exhaust manifold to form the cavity. The cavity is further defined by a perpendicular projection of a cover member covering the upper portion of the engine. Fixing bolts remain accessible below the cover member when a removable cover is removed, thereby improving accessibility of the heat-generating electronic component. Locating the cavity under the perpendicular projection of the fixed cover member improves protection against the entry of moisture into the heat-generating electronic component.

According to an embodiment of the invention, there is provided a structure for mounting components of an outboard motor wherein: an exhaust manifold and an electronics box spaced apart on a side of an engine of the outboard motor, a space between the exhaust manifold and the electronics box forming a cavity, and a heat-discharging electronic component mounted on the side in the cavity.

According to a feature of the invention, there is provided a structure for mounting components in an engine of an outboard motor comprising: first and second components mounted spaced apart on a side of the engine, a space between the first and second components forming a cavity, a heat-discharging electronic component in the cavity, the first and second components reducing an opportunity for accidental contact of a user with the heat-discharging electronic component, a cooling water pipe for carrying cooling water for the engine, and the cooling water pipe passing outward of, and adjacent to, the heat-discharging component, thereby further reducing an opportunity for accidental contact of the user with the heat-discharging electronic component.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
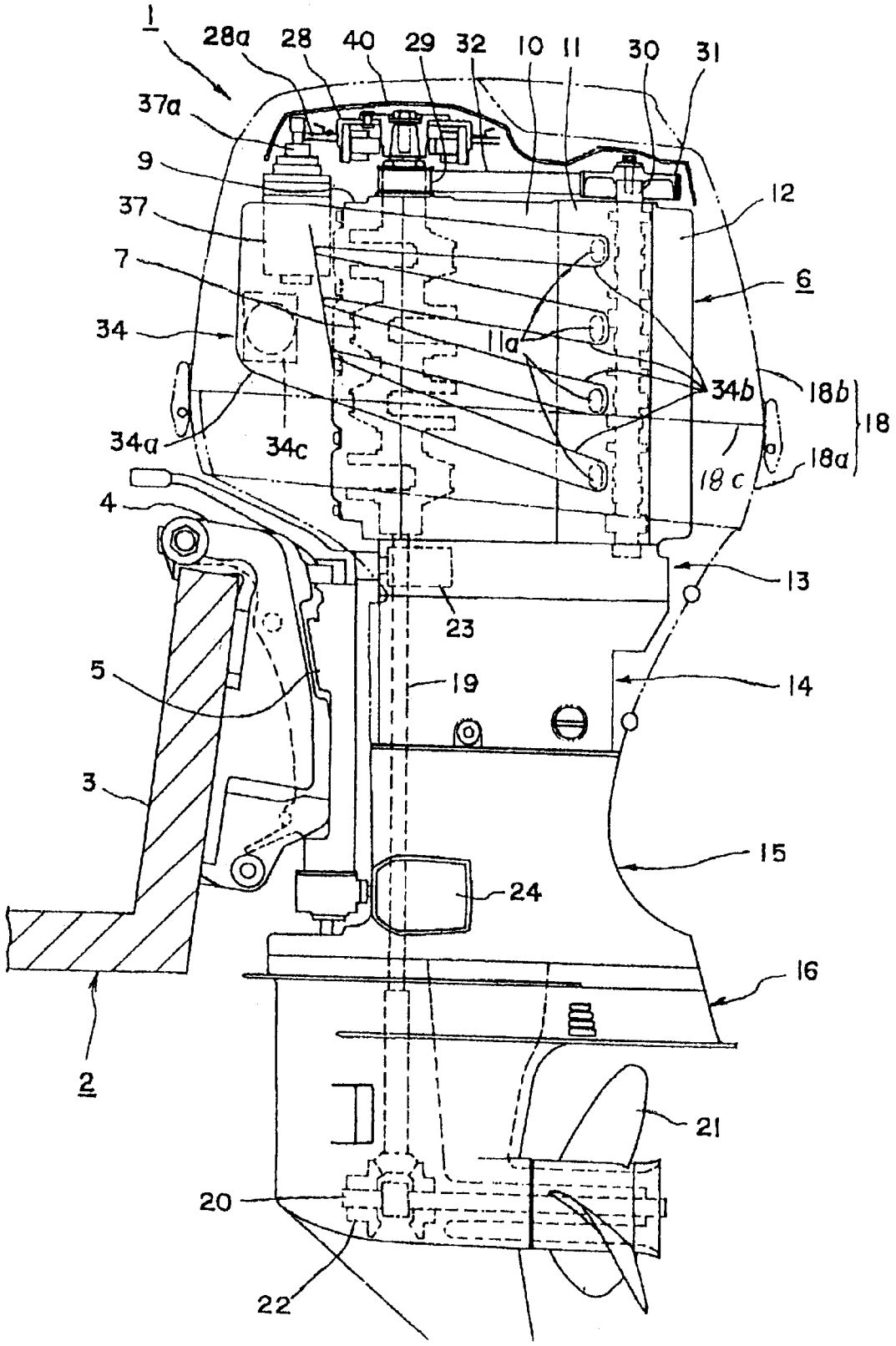
FIG. 1 is a left side view of an outboard motor according to an embodiment of the present invention.

Referring to FIG. 1, an outboard motor 1 is left-right pivotable about a swivel shaft 5. Swivel shaft 5 is mounted on a transom 3 of a hull 2 by a clamp bracket 4 and is disposed vertically at the rear of the clamp bracket 4.

An engine 6 is mounted at the uppermost portion of outboard motor 1. Engine 6 is, for example, an in-line four-cylinder water-cooled gasoline engine. A crank shaft 7 of engine 6 is mounted vertically.

Figure 2:
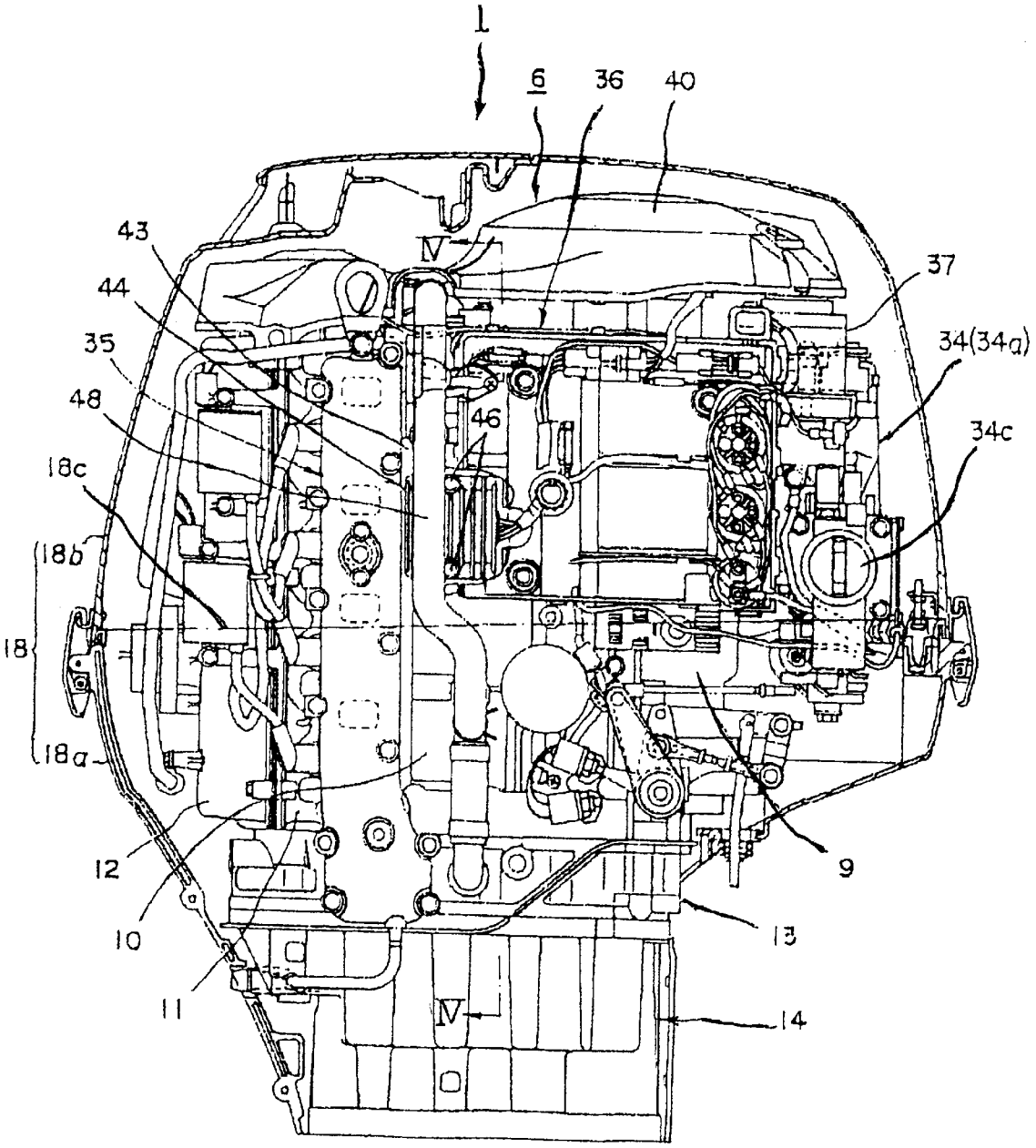
FIG. 2 is a right side view of the engine of FIG. 1.
Figure 3:
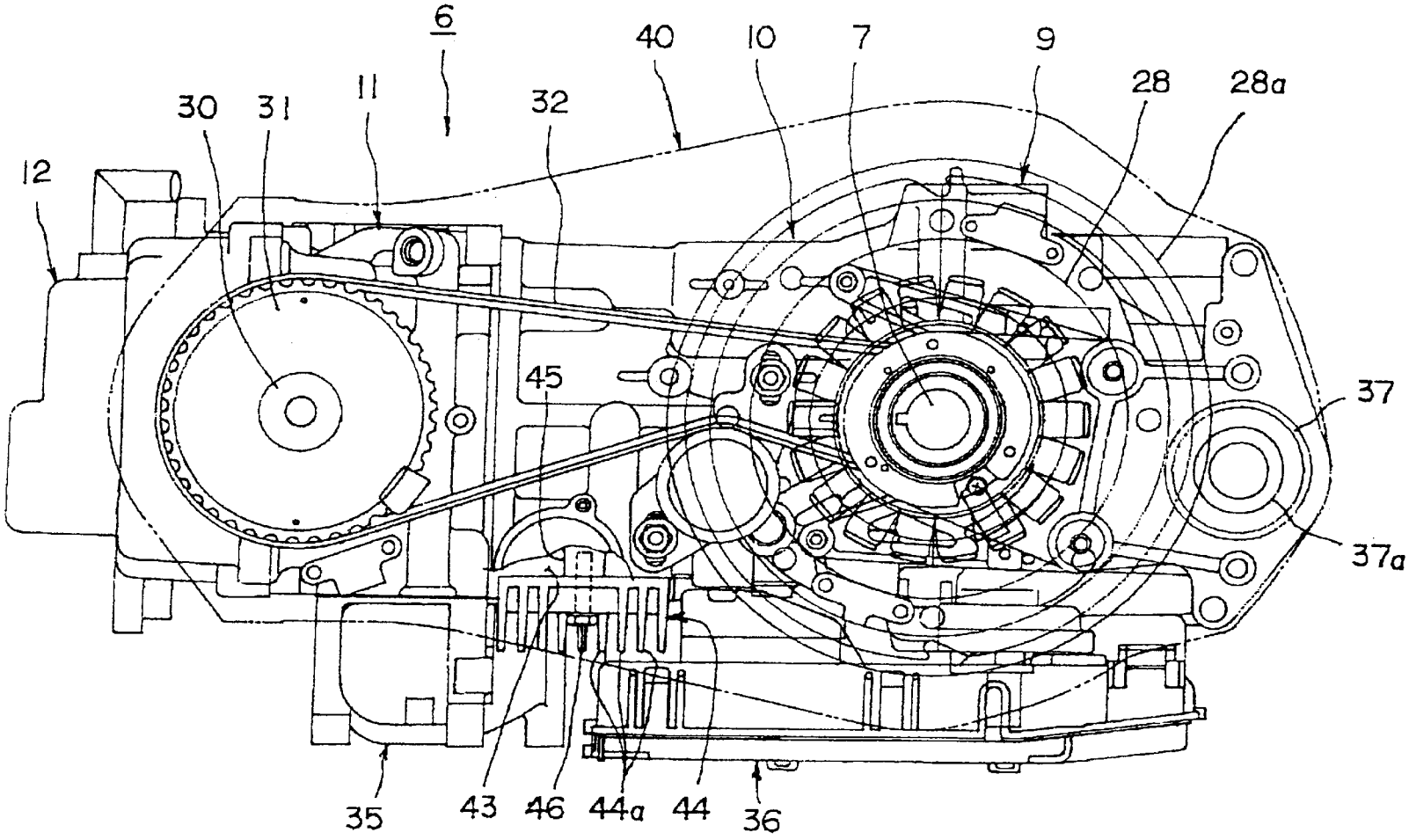
FIG. 3 is a plan view of the engine of FIG. 1.

Referring to FIGS. 2 and 3, engine 6 is assembled with a crank case 9, a cylinder block 10, a cylinder head 11, a head cover 12 disposed in this sequence from the front to the rear.

An oil pan 14 is fixed to the lower portion of engine 6 on an engine holder 13. Engine holder 13 is preferably a thick plate. A drive shaft housing 15 (FIG. 1) extends downward below the lower portion of oil pan 14. A fixed gear housing 16 is connected below drive shaft housing 15.

Engine 6, engine holder 13, and oil pan 14 are covered by an engine cover 18. Engine cover 18 is made up of a lower cover 18*a* and an upper cover 18*b*, which meet at a dividing line 18*c*. Lower cover 18*a* extends below cylinder head 11 and oil pan 14. Upper cover 18*b* is removably mounted above lower cover 18*a*. Maintenance access to engine 6 attained by removing upper cover 18*b*.

A bottom end of crank shaft 7 of engine 6 is connected to a drive shaft 19, which extends downward. Drive shaft 19 and crank shaft 7 are connected for integral rotation. Drive shaft 19 passes through engine holder 13, oil pan 14, and drive shaft housing 15 into gear housing 16.

A propeller shaft 20, rotatably supported in gear housing 16 extends from the front and back of gear housing 16. A propeller 21 is disposed on the rear end of propeller shaft 20 for integral rotation therewith. A bevel gear mechanism 22 disposed at the intersection of drive shaft 19 and propeller shaft 20 transfers the rotation from drive shaft 19 to propeller shaft 20, thus rotating propeller 21.

Left and right mount sections 23, 24 are disposed on the front rim of engine holder 13 and drive shaft housing 15 respectively. These upper and lower mount sections 23, 24 are rotatably supported at the upper end and the lower end on swivel shaft 5 respectively.

The upper end of crank shaft 7 projects up from the upper surface of engine 6. A flywheel 28 is disposed on the projecting section of crank shaft 7 so that the two rotate integrally. A drive pulley 29 is disposed at the lower portion of flywheel 28.

A cam shaft 30 is rotatably supported within cylinder head 11 parallel to crank shaft 7. The upper end of cam shaft 30 projects from the upper surface of engine 6. A driven pulley 31 is disposed on this projecting section so that the two is rotated integrally.

A timing belt 32 extends between drive pulley 29 on crank shaft 7 and driven pulley 31 on cam shaft 30. Timing belt 32 transfers the rotation of crank shaft 7 to cam shaft 30, thus activating a conventional valve mechanism (not shown in the drawings) disposed within cylinder head 11.

A fuel-injection intake device 34 is disposed on the left side surface of engine 6. An exhaust manifold 35 and an electronics box 36 are disposed on the right side surface of engine 6. On the front surface of engine 6 is disposed a starter motor 37 for starting outboard motor 1.

Intake device 34 comprises: a surge tank 34*a*; four intake branches 34*b* extending to the rear from surge tank 34*a* and connecting to intake port 11*a* (see FIG. 1), which open to the left side surface of cylinder head 11; and a throttle body 34*c* connecting to the lower portion of the right side surface of surge tank 34*a* and positioned below starter motor 37.

A ring gear 28*a* encircles flywheel 28. When starter motor 37 is energized, a pinion gear 37*a* of starter motor 37 is projected upward to mesh with ring gear 28*a*. Crank shaft 7 is thus rotated and engine 6 is started.

The upper section of engine 6 is covered by a cover member 40 formed from a synthetic resin or the like. In addition to the upper section of engine 6, flywheel 28, drive pulley 29, driven pulley 31, timing belt 32, starter motor 37, and the like are also covered. Cover member 40 blocks water droplets, and other contaminants falling from above, from entering engine outboard motor 1, and thus protects the parts from water and dirt.

Figure 4:
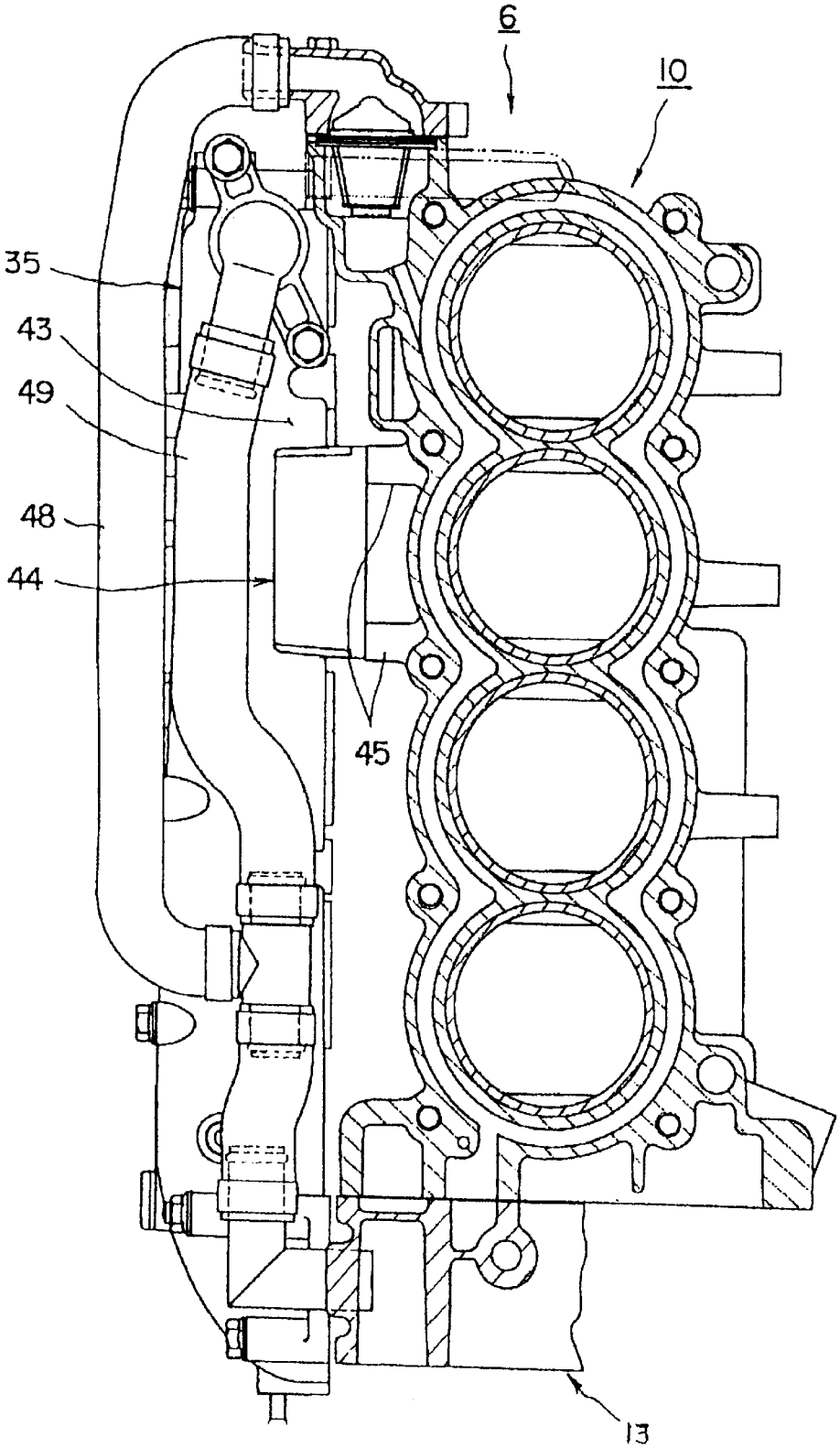
FIG. 4 is a vertical cross-section drawing of the engine taken along the IV—IV in FIG. 2.

Referring to FIG. 2–FIG. 4, a heat-discharging electronic component such as a regulator 44 is disposed within a cavity 43 formed between the right side surface of engine 6 (cylinder block 10) and exhaust manifold 35 and electronics box 36. By mounting this type of heat-discharging electronic component separately and outside electronics box 36, the electronic and other parts contained in electronics box 36 are protected from being damaged by heat.

Referring to FIG. 3 and FIG. 4, upper and lower cylindrical fastening bases 45 are formed integrally with the right side surface of cylinder block 10. Regulator 44 is fixed firmly to the two fastening bases 45 via fixing bolts 46.

Regulator 44 is mounted within a space defined by the perpendicular projection of cover member 40 covering engine 6 (see FIG. 3). The mounting position of regulator 44 is also above a dividing line 18*c* of engine cover 18 when seen from the side (see FIG. 2). Furthermore, the fixing section (fixing bolts 46) of regulator 44 are left uncovered by electronics box 36 and other members, so that they remain accessible for maintenance when cover member 40 is removed.

Referring to FIG. 3, in this embodiment approximately half of the front side of regulator 44 is covered by electronics box 36, but the fixing bolt 46 section is exposed to the side.

A plurality of heat-discharging fins 44*a* is formed in a parallel arrangement on the outer surface of regulator 44. These heat discharging fins 44*a* are oriented longitudinally up and down. Referring to FIG. 2 and FIG. 4, cooling water pipes 48, 49, which are connected to engine 6 and exhaust manifold 35, are disposed so that they pass the outer side of regulator 44. Cooling water pipes 48, 49, since they carry cooling water for the engine, and pass close to heat discharging fines 441, tend to cool regulator 44.

Regulator 44 is disposed as described above. By mounting regulator 44 in a cavity 43 formed between the right side surface of engine 6 and exhaust manifold 35 and electronics box 36, the dead space at the right side surface of engine 6 is used efficiently, and regulator 44 is mounted without unnecessarily restricting the layout of other parts in outboard motor 1. At the same time, space at the left side surface remains available to be allocated for other purposes.

Also, since regulator 44, which discharges heat, is contained within cavity 43, the user can be prevented from coming into contact with regulator 44 without the need to implement special protective measures. This reduces the number of required parts and assembly steps. Furthermore, cover member 40, which covers the upper portion of engine 6, blocks water dropping from above, thus protecting regulator 44 from water.

Regulator 44 is mounted at a position above dividing line 18*c* of engine cover 18 (when seen from the side). Fixing bolt 46, which serves as the fixing section for regulator 44, is not covered by electronics box 36 or other members. Thus, regulator 44 can be removed simply by removing upper engine cover 18*b*. This allows regulator 44 to be easily removed and inserted.

If water infiltrates through dividing line 18*c* of engine cover 18 due to a wave hitting outboard motor 1 or the like, the water is prevented from reaching regulator 44, which is positioned above dividing line 18*c*. Furthermore, even when upper cover 18*b* is removed, regulator 44 remains protected to some degree from water spraying from the side since about half of regulator 44 is shielded by electronics box 36.

A cooling air flow generated by the rotation of members such as flywheel 28 and ring gear 28*a* inside cover member 40, passes through the vertically orientated length of heat-discharging fins 44*a* of regulator 44. This allows the cooling air to smoothly flow between heat discharging fins 44*a* of regulator 44. This improves the cooling of regulator 44.

Cooling water pipes 48, 49, which connect to engine 6 and exhaust manifold 35, are disposed so that they pass outside and to the side of regulator 44. This allows cooling water pipes 48, 49 to function as protective members for regulator 44. Thus, the user is prevented from coming into contact with regulator 44 without the need for a special protective measure that would involve increasing the complexity of the structure.

Regulator 44 in this embodiment is used only as an example of a heat-discharging electronic component. The same advantages can be obtained by disposing other heat-discharging electronic components in cavity 43 formed between the side surface of engine 6 and exhaust manifold 35 and electronics box 36.

As described above, in the structure for mounting electronic components of an outboard motor according to the present invention, a heat-discharging electronic component is mounted in a cavity formed between a side surface of an engine, an exhaust manifold, and an electronic components box. The heat-discharging electronics box is mounted within the space defined by the perpendicular projection of a cover member covering the upper portion of the engine. This allows the heat-discharging electronic component to be mounted so that the dead space on the side surface of the engine can be used efficiently and so that the layout of parts in the outboard motor is kept efficient. Furthermore, the user is prevented from coming into contact with the heat-discharging electronic component without requiring special protective measures, thus preventing the number of required parts or assembly steps from increasing. Furthermore, the cover member blocks water dropping down from above, thus protecting the heat-discharging electronic component from moisture.

In the structure for mounting electronic components of an outboard motor according to the present invention, the heat-discharging electronic component is positioned above a dividing line of the engine cover, which covers the entire engine and which is divided into upper and lower portions. The heat-discharging electronic component is also positioned so that its fixing section is not covered by other members. This allows the heat-discharging electronic component to be easily inserted and removed, and also protects the electronic component from moisture when water infiltrates through the dividing line of the engine cover.

In the structure for mounting electronic components of an outboard motor, the heat-discharging fins of the heat-discharging electronic component is oriented lengthwise up and down. This allows the cooling air flowing from above to actively flow between the heat-discharging fins of the heat-discharging electronic component, thus improving the cooling to the electronic component.

In the structure for mounting electronic components of an outboard motor, the cooling pipes connected to the engine and the exhaust manifold are disposed so that they pass outside near the heat-discharging electronic component. This allows the cooling pipes to also serve as protective members, thus preventing the user from coming into contact with the heat-discharging electronic component without requiring a special protective measure involving a more complex structure. In addition, the proximity of the cooling pipes enhances cooling of the heat-discharging electronic component.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A structure for mounting components of an outboard motor wherein:

an exhaust manifold and an electronics box spaced apart on a side of an engine of said outboard motor;

a space between said exhaust manifold and said electronics box forming a cavity;

a heat-discharging electronic component mounted on said side in said cavity;

at least one cooling water pipe;

said at least one cooling water pipe carrying cooling water for said engine; and said at least one cooling water pipe being disposed to pass to an outside of and to a side of said heat-discharging electronic component, whereby accidental contact of a user with said heat-discharging component is avoided.

2. A structure for mounting components according to claim 1, further comprising:

a cover member covering an upper portion of said engine; and said cavity being further defined by a space below a perpendicular projection of said cover member.

3. A structure for mounting components according to claim 1 further comprising:

an engine cover;

said engine cover covering substantially an entirety of said engine;

said engine cover being separable into an upper cover and a lower cover at a dividing line;

said cavity being disposed above said dividing line;

said heat-discharging electronic component being affixed to said engine by at least one fixing member; and said at least one fixing member remains accessible for removal when said upper cover is removed.

4. A structure for mounting components according to claim 1 further comprising:

at least one heat-discharging fin on said heat-discharging electronic component; and said fin is oriented vertically, whereby engine cooling air flowing therepast is effective to cool said heat-discharging electronic component.

5. A structure for mounting components in an engine of an outboard motor comprising:

first and second components mounted spaced apart on a side of said engine;

a space between said first and second components forming a cavity;

a heat-discharging electronic component in said cavity;

said first and second components reducing an opportunity for accidental contact of a user with said heat-discharging electronic component;

a cooling water pipe for carrying cooling water for said engine; and said cooling water pipe passing outward of, and adjacent to, said heat-discharging component, thereby further reducing an opportunity for accidental contact of said user with said heat-discharging electronic component.

6. A structure according to claim 5, further comprising:

a removable cover covering an upper part of said engine;

at least one fixing device for fixing said heat-discharging electronic component to said engine; and said fixing device being directly accessible for removal thereof when said removable cover is removed.

7. A structure according to claim 6, further comprising:

a permanent cover covering an upper part of said engine; and said fixing device being accessible below a lower portion of said permanent cover.

* * * * *